United States Patent [19]

Owsley

[11] Patent Number: 4,976,623

[45] Date of Patent: Dec. 11, 1990

[54] PORTABLE DEVICE FOR TEACHING TUMBLING

[76] Inventor: Joseph L. Owsley, 1376 Sailboat Cir., Wellington, Fla. 33414

[21] Appl. No.: 340,714

[22] Filed: Apr. 20, 1989

[51] Int. Cl.[5] ..... A63B 69/00

[52] U.S. Cl. ..... 434/247; 272/109

[58] Field of Search ..... 434/247; 272/70 A, 70, 272/109, 111, 24, 61; 104/62

[56] References Cited

U.S. PATENT DOCUMENTS

| | | | |
|---|---|---|---|
| 1,064,968 | 6/1913 | Hagen | 272/69 |
| 1,419,890 | 6/1922 | Noel | 272/70 A |
| 2,812,010 | 11/1957 | Abdallah | 272/70 A |
| 3,085,357 | 4/1961 | Nissen et al. | 272/109 |
| 3,432,163 | 1/1968 | Murphy | 272/109 |
| 4,340,215 | 7/1985 | Murphy | 272/109 |
| 4,549,732 | 10/1985 | Hoffman | 272/70 |

FOREIGN PATENT DOCUMENTS 596738 of 1925 France .

*Primary Examiner*—Richard J. Apley
*Assistant Examiner*—Rachel M. Healey
*Attorney, Agent, or Firm*—Harry W. Barron

[57] ABSTRACT

A tumbling teaching and practice device includes a pair of side supports and a floor support. The floor support is hingedly affixed to be collapsible and thereby permit the device to be compacted for storage when not in use. The floor support includes a pair of hingedly affixed floor boards which are rotated against the sides when the device is collapsed and fit juxtaposed to one another when the device is expanded for use. In addition, a floor mat fits on top of the floor boards. The two side frames support a channel having a round member therein. A roller assembly is affixed to the round member to be able to easily travel laterally along the length of the device. Straps may bone attached from each roller assembly and are adapted to be affixed to a belt worn by the student using the device. The student may then be assisted in learning to do tumbling exercises by an instructor holding onto or feling the strap or the student may practice exercises already known by wearing the belt and adjusting the straps to be almost tight. Should the student fall or perform an exercise incorrectly the belt and straps would prevent the student from being injured by breaking dangerous falls to the ground.

6 Claims, 3 Drawing Sheets

PORTABLE DEVICE FOR TEACHING TUMBLING

This invention relates to a device for teaching tumbling excercises and for permitting a student to practice tumbling excercises, and more particularly, to such device which may be folded for storage and moved through conventional size doorways from one area to another for use or storage.

In recent years, the sport of gymnastics has become increasingly popular and certain aspects of gymnastics training are being utilized in other sports. For example, cheerleaders for high school and college athletic events are now utilizing basic tumbling routines in their presentations to the crowds. While most accomplished gymnasts will have begun their training at an early age, the typical high school or college cheerleader will not have begun tumbling training until their teenage years. Particularly for these late starters, it is necessary to provide apparatus which will assist the student in learning the basic tumbling excercises, such as front and back hand springs, somersualts, standing tucks, layouts and the like. These students not only must learn the techniques of doing the basic excercises, but also must be taught to overcome the inherent fear of performing a tumbling exercise an older child naturally develops.

In the past, various devices have been developed to assist the tumbling student to learn and practice the various exercises. Each of these prior art devices have typically utilized a belt around the waist of the student attached to mechanisms over the head of the student. These mechanisms have generally included sliding means to permit the belt to slide over a certain length so that the student can practice the various excercises. For example, such tumbling apparatus is shown in U.S. Pat RE No. 25,843 in the name of Nissen el al entitled "Teaching Aid For Tumbling"; U.S. Pat. No. 994,567 in the name of Berzak entitled "Apparatus For Training And Amusement Purposes"; U.S. Pat. No. 2,107,377 in th name of Howland entitled "Apparatus For Teaching Tumbling"; U.S Pat. No. 3,372,926 in the name of Murphy entitled "Playground And Gymnastic Equipment for Tumbling Excercise"; U.S. Pat. No. 3,379,439 in the name of Sorenson et al entitled "Slide Horse Training Device"; U.S. Pat. No. 3,432,163 in the name of Murphy entitled "Twisting And Tumbling Belt"; and U.S. Pat. No. 4,410,175 in the name of Shamp entitled "Safety Suspension Unit And Harness For Developing Jumps In Figure Skating".

In many of the aforementioned patents, the apparatus is typically affixed from a ceiling, or an extension from the ceiling, and includes one or more straps extending downward to a belt or other similar type device attached to the student. Other types of prior tumbling apparatus included large and cumbersome frames which had to be built around and over the student, and which function generally in the same manner as the device attached to the ceiling. The problem with both of the prior art type devices is that the devices are permanent and bulky and not easily placed in storage when not in use, or moved between alternate locations for use. The prior art devices are adequate for their intended purpose of permanent installation in a school dedicated to teaching gymnastics, where use of the apparatus occurs most every day and dedicated space is available for the devices. However, they are not practical for use in a school situations, for example, where teaching basic tumbling excerises is only one of the many activities performed in a limited available space, such as a gymnasium. Permenant type tumbling assistance devices further are not practical where the tumbling activity may only be practiced for a short time period, such as a few weeks in physical education class, or a few months constituting a sports season.

When it is desirable to have tumbling apparatus used to train cheerleaders, for example, the apparatus will typically be owned by a public or private school system. Generally, space for athletic training is limited and must be shared between various, different sport activities. For example, the cheerleaders may be permitted to use the gymnasium during the time of the year the basketball team is not practicing, or during certain times of the day when other activities in the gymnasium are not taking place. Even when permitted to use the gymnasium, the cheerleader squad may only be given a small area in which to practice its routines. In view of the limited time and space availability, the prior art tumbling assistant devices become impractical for use for several reasons. First, the prior art devices can not be permitted to hang from the ceiling because they would interfere with other activities taking place in the same room. Further, there is no place in which the devices can be stored when not in use, unless a total disassembly and removal first occurs. In addition, the prior art tumbling assistant apparatuses can not be easily and quickly moved to smaller alternate practice areas when the main gymnasium facility is not available for practice or teaching of the tumbling student. A device which solves the above noted problems is required for practical use in the school setting.

In accordance with one aspect of this invention there is provided a device for teaching tumbling comprising a pair of separated horizontal and parallel side channels positioned above a tumbling plane entirely therebetween. In addition, the device has sliding means for sliding along the length of each channel and a pair of straps, at least one of which is affixed to the sliding means. Further, the device includes belt means affixed to both of the straps of a type for affixation to the waist of a tumbler using the device.

One preferred embodiment of the subject invention is hereafter described, with specific reference being made to the following Figures, in which.

Figure 4:
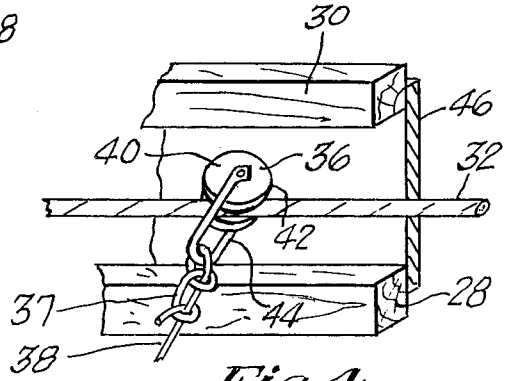
Figure 5:
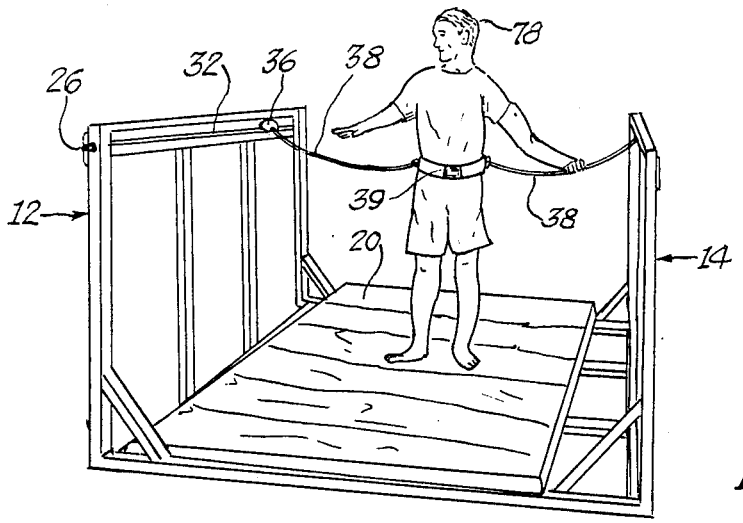
Figure 6:
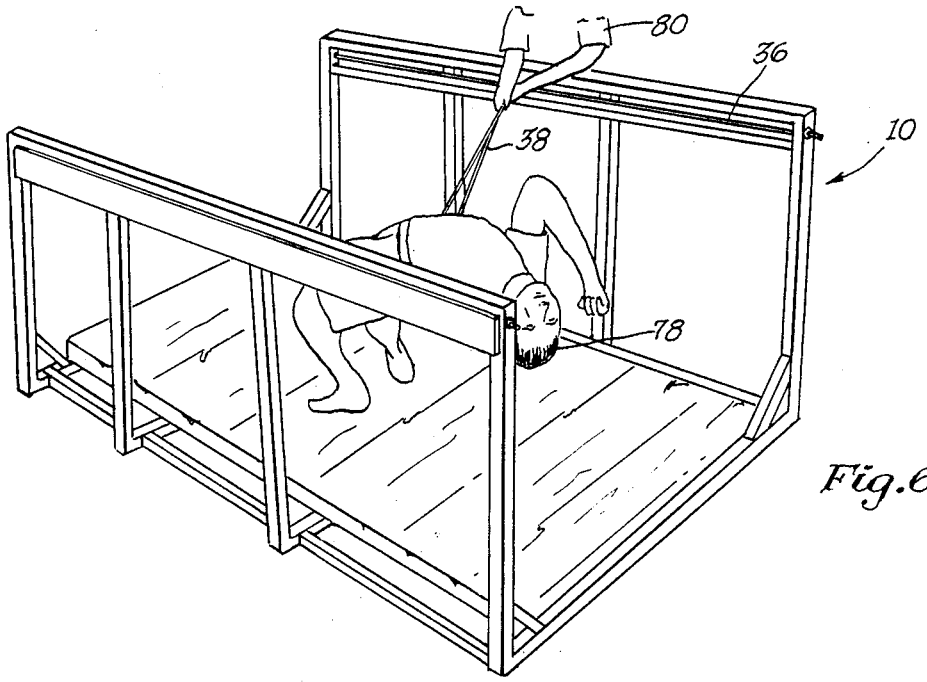
Figure 7:
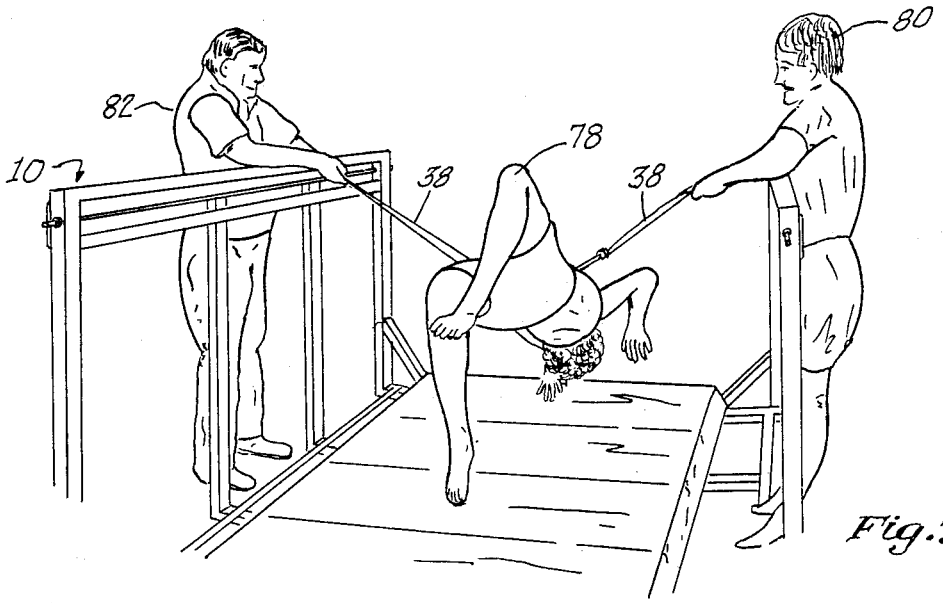

FIG. is a side view of the portable tumbling teaching device in the closed position;

FIG. 4 is a close-up view of the slide mechanism of the portable tumbling teaching device;

FIG. 5 is a veiw showing a student using the portable tumbling teaching device;

FIG. 6 is a view showing a single instructor assisting the student using the portable tumbling teaching device;

FIG. 7 is a view showing two instructors assisting a student using the portable tumbling teaching device.

Referring now to FIGS. 1, 2, 3 and 4, the basic structural elements of the portable tumbling teaching and practicing device 10 will be described. Device 10 includes left side frame portion 12 and right side frame portion 14, the latter of which is shown partially cutaway. The two side frame portions 12 and 14 are mirror images of one another and only left side portion 12 will be described in detail. In addition, device 10 includes a floor frame portion 16, which holds a floor board 18 and protection mat 20, both of which are shown partially cut-away, it being understood that floor board 18 and mat 20 extend substantially over the entire floor frame portion 16.

Each of the side frame portions 12 and 14 include four uprights 22, each of which are welded to a corresponding corner piece 24. The eight corner pieces 24 are hingedly connected to floor frame portion 16 in a manner to be described hereafter and adjacent corner pieces 24 are separated by separator pieces 48 to provide structural stability and physical size integrity. The two outside uprights 22 are approximately four inches taller than the two interior uprights 22 so as to permit a channel structure 26 to be positioned above the two interior uprights 22 and between the two exterior uprights 22. A angular bracket 68 is angularly positioned between each outside upright 22 and its corresponding corner piece 24 and is used to provide additional support and rigidly, as well as for affixaiton of floor 18. Channel structure 26 includes a pair of separated horizontal members 28 and 30 and a round member 32 between the two horizontal members 28 and 30. Round member 32 may be a heavy steel cable affixed to the outer uprights 22 by eyebolts 34 and appropriate cable clamps. The length of uprights 22 are selected so that the heights of round member 32 is approximately 50 inches above the ground, or in other words, between the waist and neck of the average student.

A roller assembly 36, having a strap 38 affixed thereto, travels easily along round member 32 the length of channel 26. The two straps 38, extending from the two channels 26, are each attached to a belt 39 adapted to be worn by the student using device 10. A detail illustration of the roller assembly 36 is shown in FIG. 4. Roller assembly 36 includes a circular member 40 having a concave peripheral surface 42 adapted to roll over round member 32. A stationary handle 44 is pinned to the stationary axle around which circular member 40 rotates. Handle 44 extends over and to the front of circular member 40 to permit strap 38 to be affixed thereto be a conventional knot 37 and to laterally pull roller assembly 36 along round member 32 as a student, wearing a belt 39 to which that strap 38 is affixed, moves within device 10. The outward facing side of channel 26 is covered with a guard plate 46 to prevent the hand of an instructor or observed from being caught as roller assembly 36 travels along round member 32 while the student wearing belt 39 practices tumbling excercises. In addition, a pad 47 may be placed over the top horizontal member 30, or the upright members 22 to protect the student in case physical contact is made with device 10.

Figure 2:
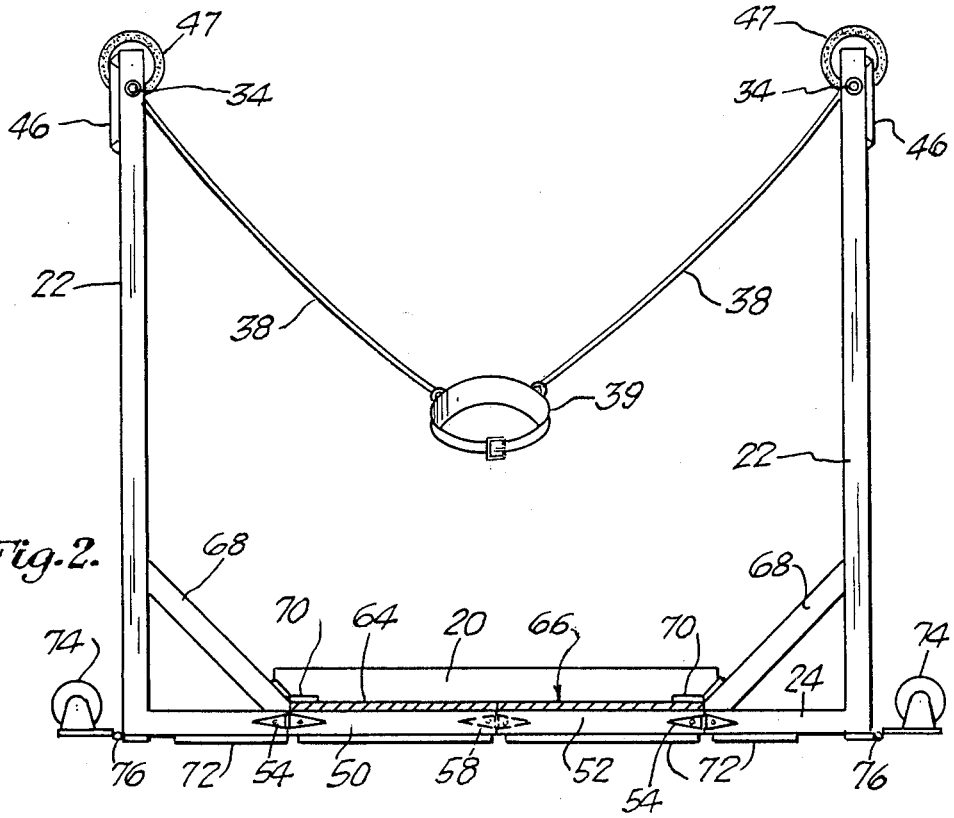
FIG. 2 is a side view of the portable tumbling teaching device in the open position.
Figure 3:
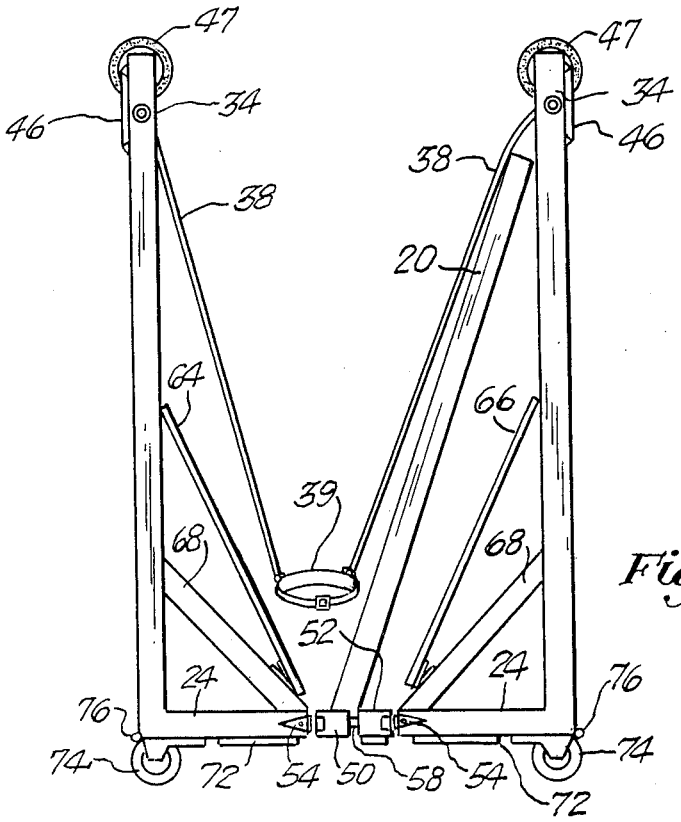

As best seen in FIGS. 2 and 3, both sides of belt 39 are attached to the two straps 38 extending from the two roller assemblies 36 in each of the two channels 26 of left and right side frame portions 12 and 14. Straps 38 should be adjusted in length when ties to the roller assembly handle 44 to have only a slight amount of slack when a student using device 10 is wearing belt 39 around his or her waist. Connected in this manner, the student's head is protected from injury if he or she falls, when doing a front or back hand spring or other similar exercise, since belt 39 will break the fall before the student's head can hit floor mat 20.

As previously mentioned, floor frame portion 16 hingedly mates with the corner pieces 24. Specifically, the end of corner pieces 24, remote from the uprights 22, is hingedly affixed to floor frame portion 16, and specifically to floor members 50 and 52 thereof. More specifically, one end of each floor members 50 is connected by a hinge 54 to the remote end of a mating corner piece 24 of left side frame portion 12 and one end of each floor member 52 is connected by a hinge 56 to the remote end of a mating corner piece 24 of right side portion 14. Both hinges 54 and 56 are placed on the same respective side of corner pieces 24 and floor members 50 and 52, so that both floor members 50 and 52 rotate in the same linear direction. In addition, the other end of floor members 50 and 52 are coupled together by a hinge 58, which is positioned on the opposite side of floor members 50 and 52 relative to the position of hinges 54 and 56.

Figure 1:
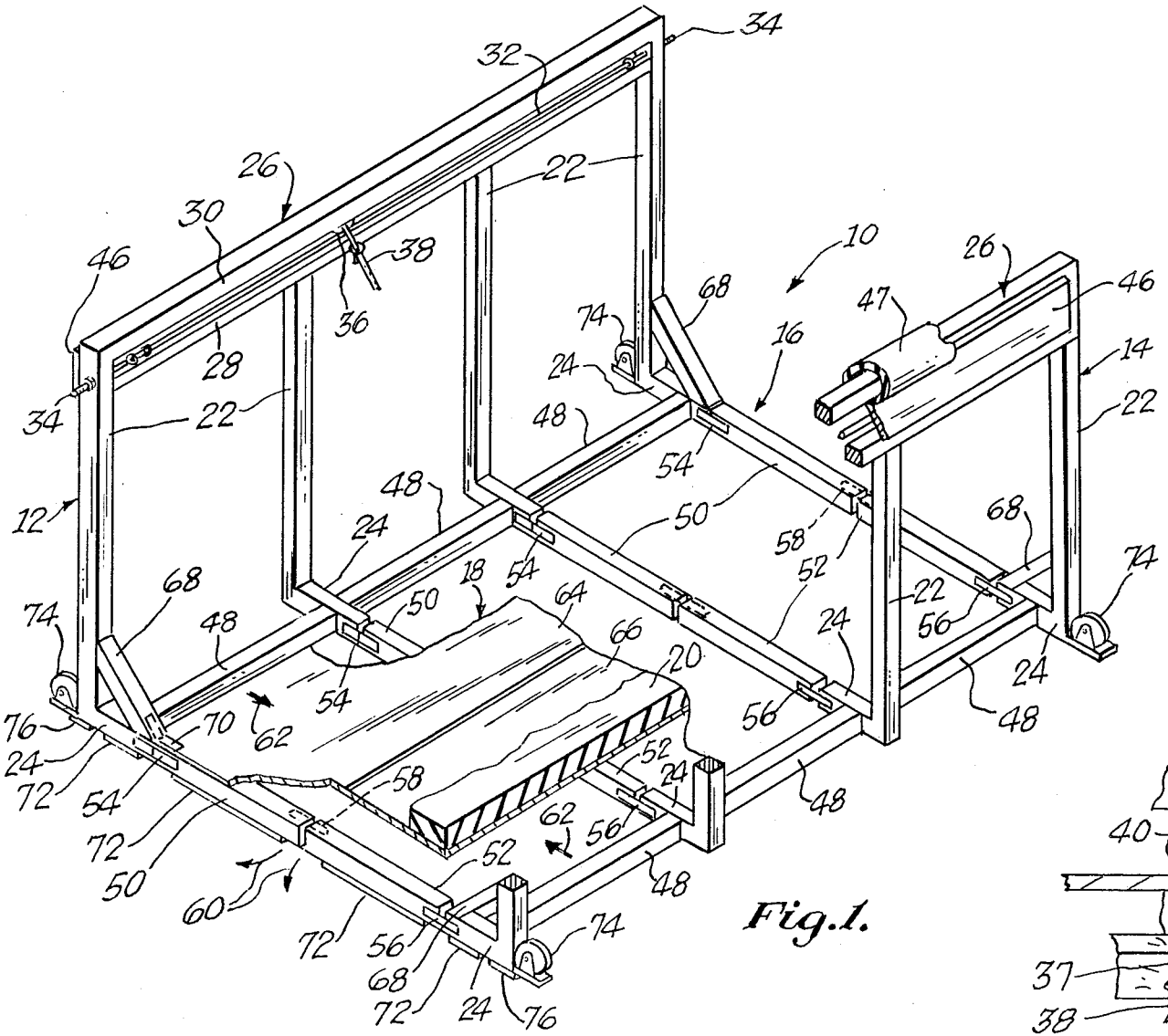
FIG. 1 is a perspective view, partially in cut-away, of the portable tumbling teaching device of the subject invention.

Device 10 may be compacted for storage when not in use by rotating floor members 50 and 52 in the direction indicated by arrows 60. Thus, when the floor members 50 and 52 are rotated in the direction of arrow 60, left side portion 12 and right side portion 14 are drawn together as indicated by the arrows 62. The expanded, or usable size of device 10 is illustrated in FIGS. 1 and 2 and compacted, or storable size, of device 10 is illustrated in FIG. 3. In actual size, each of floor members 50 and 52 may be twenty-four inches in length and each of outer two spacers 48 may be twenty-eight and the length of the inner spacer 48 may be twenty-nine inches in length. If two inch square tubing construction material is used for all structural parts, the overall length of device 10 will be approximately 94 inches and the width available for floor 18 and pad 20 will be forty-eight inches, thereby permitting conventional four foot by eight foot plywood sheets and safety mats to be utilized. By making the corner pieces 24 have a floor length of twelve inches, device 10 is approximately 28 inches when compacted. Thus, device 10 can be stored in a much narrower position than the position it assumes when in use.

Floor 18 consists of to panels 64 and 66, both of which together constitute a single four foot by eight foot sheet of plywood cut lengthwise in half. Each of the outer uprights 22 is connected to the corresponding corner piece 24 by an angular bracket 68, which is coupled from the respective outer upright to the end of the corner piece 24 to provide additional strength and stability to the channels 26 in the side portions 12 and 14. In addition, each of the two floor panels 64 and 66 are hingedly attached by hinges 70 to the angular bracket 68. Coupled in this manner, one may remove the mat 20 and rotate the floor panels 64 and 66 about hinges 70, so that the center edges rest against the respective side portions 12 and 14. This is only done in conjuction with placing device 10 in the compacted position, as shown in FIG. 3, for storage.

During use of device 10, it is desired that it rest directly upon the floor of the gymnasium or room in which it is used. In order to avoid damaging the floor and prevent the sliding of device 10, non-skid padding 72 is placed on the bottom of corner pieces 24 and floor members 50 and 52. In order to easily move device 10 after it has been compacted by resting floor panels 64 and 66 against side portions 12 and 14 and by rotating floor members 50 and 52 in the direction of arrows 60, casters 74 are provided. Casters 74 are connected to the bottom of the outside corner pieces 24 by hinges 76 and may be placed in the position shown in FIGS. 1 and 2 when device 10 is being used by a student, or may be rotated to the position beneath the four outer corner pieces 24 when device 10 is compacted, as shown in FIG. 3. When casters 74 are in the position shown in FIGS. 1 and 2, device 10 is prevented from moving in reaction to the excercises of the student by the non-skid padding 72 and when casters 74 are in the position shown in FIG. 3, device 10 can easily be moved through conventional sized doors openings to another room for setup or a storage location.

Referring now to FIGS. 5, 6 and 7, method of using device 10 will now be described. As seen in FIG. 5, the student 78 puts belt 39 around his or her waist and attaches two straps 38 to two side receptacles on belt 39. One or both of the straps 38 may then be attched to the two roller assemblies 36 which roll along round members 32 in the two channels 26 formed in sides 12 and 14. If both straps 38 are attached to both roller assemblies 36, the student 78 may practice various tumbling exercises, such as front or back hadn springs, tucks, layouts or somersaults, and strap 38, which is affixed with only a slight amount of slack, will prevent the student 78 from falling onto mat 20.

Referring now to FIG. 6 and FIG. 7, an instructor 80 may interface with the student 78 using device 10 to provide basic instructions and assistance to the student 78 when learning to perform each of the tumbling exercises. As seen in FIG. 6, one of the straps 38 may be removed or loosened from one of the roller assemblies 36 and held by the instructor 80. In so doing, the instructor 80 may provide slight jerks or twists to the strap 38 being held to provide additional assistance to the student 78 when first learning to do certain tumbling exercises. Altenatively, instructor 80 may leave straps 38 tied tightly, as seen in FIG. 5, and place his hand on one of the straps 38. This procedure permits instrsuctor 80 to detect incorrect movements of student 78 by the feel from strap 38. Based on this feel, suggestions to or corrections of student 78 can be made, which otherwise would not be noted by mere observation.

As seen in FIG. 7, a second instructor 82 may be utilized to hold or feel the other strap 38 in order to provide further assistance to the student 78.

With tumbling exercises, the first time the student 78 attempts the exercise is the most critical. The slight assistance provided by a single instructor 80 or a pair of instructors 80 and 82 resulting in a completed exercise can provide the needed confidence to the student 78. Once the student 78 gains the confidence to be able to perform the various tumbling routines, the assistance provided by the instructor 80 and/or 82 may be minimized or eliminated. However, the instructor 80 and/or 82 will always have the ability to stand protected from the student at the side of apparatus 10 and provide suggestions and guidance to the student 78.

What is claimed is:

1. A device for teaching and practicing tumbling comprising:

a pair of separated horizontal and parallel side channels positioned above a tumbling plane entirely therebetween;

sliding means for sliding along the length of each channel;

a pair of straps, at least one of which is affixed to said sliding means and both of which are affixed to said sliding means;

belt means affixed to both of said straps, said belt means being of a type for affixation to the waist of a tumbler using said device;

wherein said device further includes frame means for supporting said channels and said tumbling plane; and wherein said tumbling plane includes contractible floor frame means and a planar support held by said floor frame means, said planar support including a pair of panels hingedly affixed to one of said side or floor frame means, each panel being rotated to lean against one side section when said floor frame means is contracted to permit said side sections to be placed closer together for storage of said device.

2. The invention according to claim 1 wherein the length of each of said straps is adjustable.

3. The invention according to claim 2 wherein said sliding means includes:

roller support means within each side channel; and a pair of rollers, each having means to which one of said straps can be affixed, each of said rollers traveling along said roller support means for the length of said channel as said tumbler moves lateral to said channels.

4. The invention according to claim 3 wherein said floor frame means further includes a plurality of hinged members for holding said panels, said hinged members being rotatable to permit said side sections to be contracted to be closer together for storage or said device.

5. The invention according to claim 1 wherein said sliding means includes:

roller support means within each side channel; and a pair of rollers, each having means to which one of said straps can be affixed, each of said rollers traveling along said roller support means for the length of said channel as said tumbler moves lateral to said channels.

6. The invention according to claim 1 wherein said floor frame means further includes a plurality of hinged members for holding said panels, said hinged members being rotatable to permit said side sections to be contracted to be closer together for storage of said device.

* * * * *